US005755474A

United States Patent [19]

Slomski

[11] Patent Number: 5,755,474

[45] Date of Patent: May 26, 1998

[54] DUAL SIZE CUP CARRIER

[75] Inventor: Edward J. Slomski, Crystal Lake, Ill.

[73] Assignee: Illinois Tool Works Inc., Glenview, Ill.

[21] Appl. No.: 759,468

[22] Filed: Dec. 5, 1996

[51] Int. Cl.[6] ..... B65D 71/00

[52] U.S. Cl. ..... 294/87.2; 294/159; 206/150; 206/151

[58] Field of Search ..... 294/87.2, 31.2, 294/146, 149, 159, 165; 206/145, 147, 150, 151, 152, 192, 427

[56] References Cited

U.S. PATENT DOCUMENTS

| | | | |
|---|---|---|---|
| 2,766,919 | 10/1956 | Randall | 294/159 |
| 4,093,295 | 6/1978 | Erickson | 294/87.2 |
| 4,385,691 | 5/1983 | Klygis | 294/31.2 |
| 4,850,479 | 7/1989 | Bird | 294/87.2 |
| 5,098,144 | 3/1992 | Marvin . | |
| 5,125,506 | 6/1992 | Galbierz et al. | 206/151 |
| 5,186,321 | 2/1993 | Fadus | 206/151 |
| 5,474,172 | 12/1995 | Zavatone et al. | 206/147 |
| 5,573,111 | 11/1996 | Gordon et al. | 206/151 |

*Primary Examiner*—Dean Kramer
*Attorney, Agent, or Firm*—Speckman Pauley Petersen & Fejer

[57] ABSTRACT

The cup carrier of this invention comprises a sheet of flat flexible material which forms at least one cup receiving opening and a handle. Each cup receiving opening is surrounded by a cup engaging portion that engages a tapered sidewall of a cup when the cup is inserted within the cup receiving opening. The cup engaging portion of the sheet forms an inner ring and an outer ring and bands connect the inner ring to the outer ring. A generally radial slit is positioned, preferably at an approximate midpoint, between two adjacent bands. The cup carrier permits a user to insert cups having a range of diameters into the cup receiving openings. A user can insert a small cup within the cup receiving opening and engage a sidewall of the small cup with the inner ring of the cup engaging portion. A user may alternatively insert a large cup within the cup receiving opening after breaking the inner ring along each of the generally radial slits, and engage a sidewall of the large cup with the outer ring of the cup engaging portion.

4 Claims, 1 Drawing Sheet

DUAL SIZE CUP CARRIER

BACKGROUND OF THE INVENTION

1. Field of the Invention

This invention relates to a cup carrier, constructed of a flat flexible material, which is adjustable to carry different sizes and quantities of cups.

2. Description of Prior Art

Cup carriers are used to unitize individual cups into a single portable package. Cup carriers enable a user to carry several cups while freeing the user's hands or other space to carry additional objects. Cup carriers are generally either flexible ring carriers or single-piece paperboard box carriers. Flexible ring carriers are generally constructed of a thin lightweight sheet of thermoplastic material and are usually designed to carry between one and four cups.

Marvin, U.S. Pat. No. 5,098,144, discloses a generally planar sheet of polymeric material for carrying a predetermined number of cups. The sheet includes cup engaging portions and an integral handle. A cup is inserted into a cup engaging portion until a tapered sidewall of the cup is firmly seated against an inner circumference of the cup engaging portion. Each cup engaging portion of the sheet includes at least one concentric sizing ring which is removable from the sheet along a perforation. As one or more of the concentric sizing rings are removed, the diameter of the cup engaging portion is increased. At least one of the sizing rings must be completely removed from the cup engaging portion of the sheet to accommodate cups having large diameters. As a result, the sizing rings must be separately handled and discarded.

SUMMARY OF THE INVENTION

It is one object of this invention to provide a cup carrier that is easily adjustable to hold differently sized cups.

It is another object of this invention to provide a cup carrier that does not create separate quantities of waste upon adjustment.

It is still another object of this invention to provide a cup carrier that securely retains differently sized cups.

The cup carrier of this invention comprises a sheet of flat flexible material which forms at least one cup receiving opening and a handle. Each cup receiving opening is surrounded by a cup engaging portion of the flexible material that engages a sidewall of a cup when the cup is inserted into the cup receiving opening.

The cup engaging portion of the sheet forms an inner ring and an outer ring. The inner ring is connected to the outer ring with a plurality of bands. A generally radial slit is positioned at an approximate midpoint between two adjacent bands.

The cup carrier permits a user to insert a range of cup diameters into the cup receiving openings. If a small cup is inserted into the cup receiving opening, the inner ring of the cup engaging portion engages a sidewall of the small cup. If a large cup is inserted into the cup receiving opening, the user breaks the inner ring along the generally radial slits, preferably but not necessarily each one. Once the inner ring is broken, a sidewall of the large cup engages the outer ring of the cup engaging portion.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
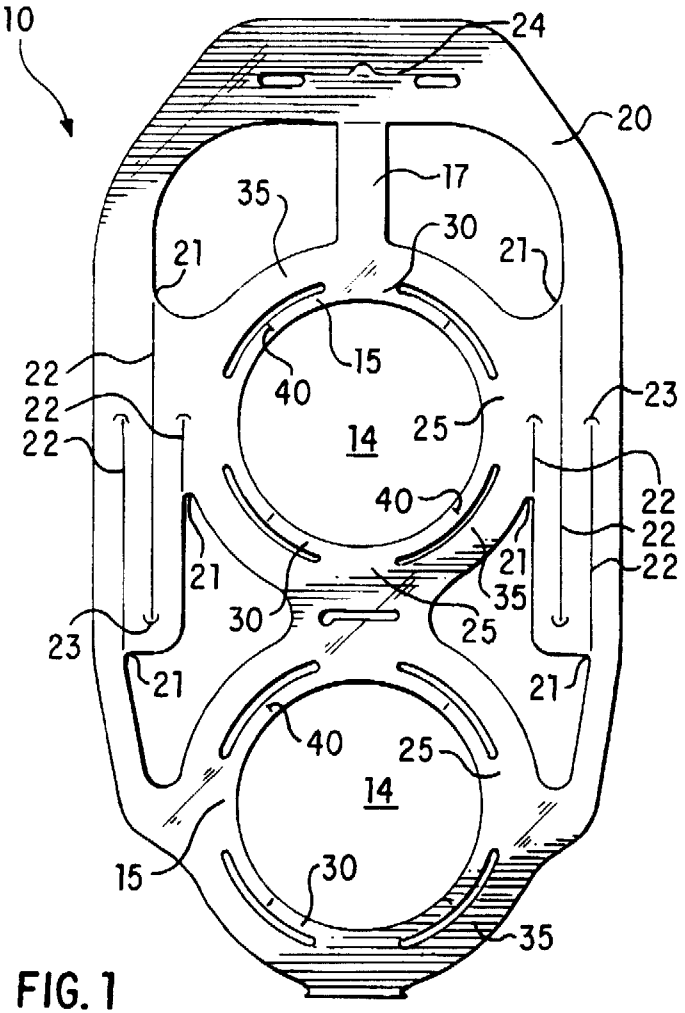
FIG. 1 is a plan view of a cup carrier according to one preferred embodiment of this invention.

FIG. 1 shows one preferred embodiment of cup carrier 10. Cup carrier 10 is constructed of a flat flexible material, preferably a thermoplastic material. In one preferred embodiment of this invention, cup carrier 10 is made from low density polyethylene.

Cup carrier 10 is preferably cut, using means known to those skilled in the art, such as a stamping die, to form a plurality of cup receiving openings 14 and handle 20. Handle 20 is designed to be wide enough to clear the top of the largest diameter cup 50, in order to pivot handle 20 from the position shown in FIG. 1 to the position shown in FIG. 2. Handle 20 is preferably defined by an outer edge of cup carrier 10 and a series of generally parallel handle slits 22. Handle slits 22 preferably extend from frangible edge 21 of cup carrier 10 along a partial length of cup carrier 10. Handle slits 22 preferably terminate at stop slit 23 positioned at an inner area of cup carrier 10, as clearly shown in FIG. 1. Stop slit 23 prevents handle slit 22 from tearing through the length of cup carrier 10 and severing handle 20 from cup carrier 10. Although shown as an arc, stop slit 23 may be configured in any manner such as to prevent handle slit 22 from tearing cup carrier 10 beyond stop slit 23.

Preferably, handle slits 22 are not die-cut completely to an edge of carrier 10. Material between handle slit 22 and frangible edge 21 is torn when handle 20 is pivoted to the position shown in FIG. 2, thus allowing material defining handle slit 22 to extend from a remainder of carrier 10. Handle slit 22 is preferably configured to prevent tangling of carrier 10 with other carriers 10 during production and storage of large numbers of carriers 10. In one preferred embodiment of this invention, frangible tab 17 that connects handle 20 with outer ring 35 also helps prevent tangling and binding among quantities of stacked or rolled carriers 10.

In one preferred embodiment of this invention, handle 20 comprises grasping slit 24 positioned in a central area of handle 20. Grasping slit 24 may be configured in any manner which permits a user to grip cup carrier 10 through a central area of handle 20.

Handle 20 is connected with respect to one or more cup engaging portions 15 which form cup receiving openings 14. Each cup receiving opening 14 accepts a single cup 49, 50. Cup 49, 50 may have a capacity between about twelve and about forty-four fluid ounces, although cup carrier may accommodate other sizes of cup 49, 50. While the preferred embodiment shows two cup receiving openings 14, any number of cup receiving openings 14 may be incorporated in cup carrier 10.

Figure 2:
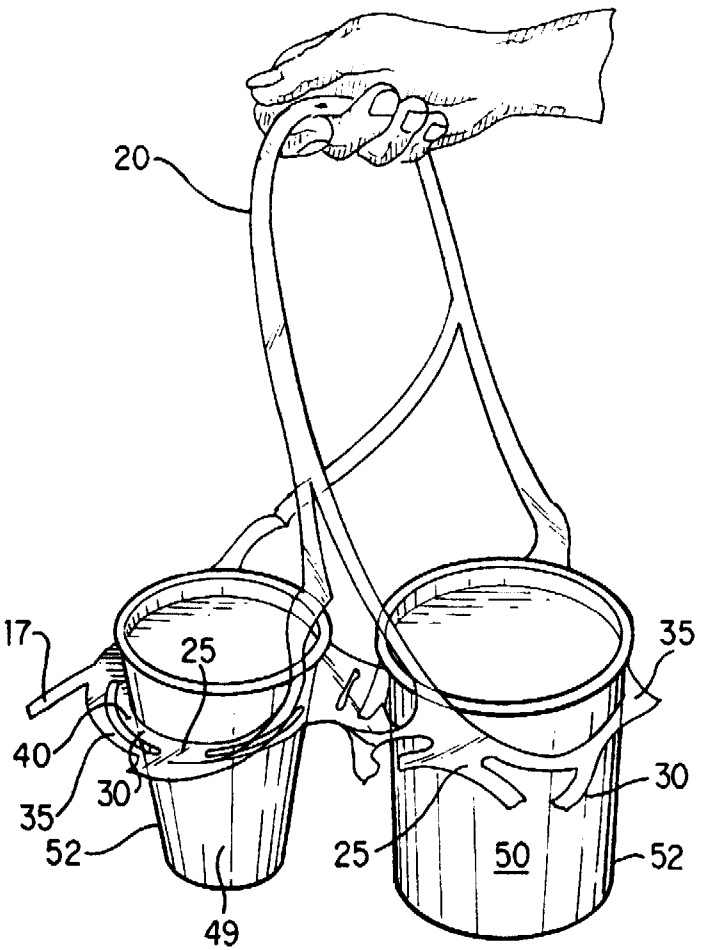
FIG. 2 is a perspective view of the cup carrier of FIG. 1 shown engaging a small cup and a large cup according to one preferred embodiment of this invention.

The flexible material of cup carrier 10 comprises cup engaging portion 15. Cup engaging portion 15 surrounds a circumference of cup receiving opening 14 and permits, upon insertion of cup 49, 50 into cup receiving opening 14, frictional contact between two cup engaging portions 15 and two cups 50 as shown in FIG. 2.

In one preferred embodiment, cup engaging portion 15 comprises inner ring 30 and outer ring 35. Inner ring 30 is connected to outer ring 35 with a plurality of bands 25. Bands 25 are preferably radially aligned with respect to cup receiving opening 14. In one preferred embodiment of this invention, shown in FIG. 1, each cup engaging portion 15 comprises four bands 25, spaced generally equidistantly around a perimeter of cup receiving opening 14, connecting inner ring 30 to outer ring 35.

Inner ring 30 of cup engaging portion 15 has a plurality of generally radial ring slits 40 between adjacent bands 25. In one preferred embodiment of this invention, one ring slit 40 is positioned between each two adjacent bands 25 and toward an outer perimeter of inner ring 30. Preferably, but not necessarily, ring slits 40 are positioned at an approximate midpoint between adjacent bands 25. If ring slits 40 are located too close to one of adjacent bands 25, one portion of inner ring 30 will protrude from cup carrier 10 at a disproportionate length when inner ring 30 is severed at ring slit 40.

The position of ring slits 40 are designed so that with small cup 49 inserted within cup receiving opening 14, tapered sidewall 52 engages inner ring 30 of cup engaging portion 15 preferably above an approximate midpoint of tapered sidewall 52. Preferably, cup engaging portion 15 is above a center of gravity of small cup 49. Inner ring 30 expands as a function of an elasticity of cup carrier 10 material as small cup 49 is nested firmly in cup receiving opening 14.

Ring slits 40 and bands 25 can be sized and designed to adjust the frangibility of inner ring 30 prior to, or upon insertion of large cup 50. Inner ring 30 may be broken by tearing ring slits 40 prior to insertion of large cup 50. Alternatively, large cup 50 may be forced through inner ring 30 causing ring slits 40 to sever inner ring 30. Once inner ring 30 is severed, large cup 50 may be inserted into cup receiving opening 14 until cup engaging portion 15 engages tapered sidewall 52 of large cup 50. Cup engaging portion 15 engages tapered sidewall 52 preferably above an approximate midpoint of tapered sidewall 52 such that a center of gravity of large cup 50 is below cup engaging portion 15. When large cup 50 is fully nested within cup receiving opening 14, severed inner ring 30 hangs loosely from bands 25 around tapered sidewall 52 of large cup 50, as shown in FIG. 2. As a result, outer ring 50 frictionally engages tapered sidewall 52 of large cup 50.

The above described configuration of cup engaging portion 15 results in cup carrier 10 that accommodates several sizes of cups 49, 50 but does not require removal and disposal of separate sizing portions of cup carrier 10.

While in the foregoing specification this invention has been described in relation to certain preferred embodiments thereof, and many details have been set forth for purpose of illustration, it will be apparent to those skilled in the art that cup carrier 10 is susceptible to additional embodiments and that certain of the details described herein can be varied considerably without departing from the basic principles of the invention.

I claim:

1. In a cup carrier constructed of a flat flexible material for carrying at least two cups, the flexible material having at least two cup receiving openings, a cup engaging portion of the flexible material surrounding each of the cup receiving openings, and a handle integrated with the flexible material, the improvement comprising:

the cup engaging portion forming an inner ring and an outer ring;

a plurality of bands of the flexible material connecting the inner ring with respect to the outer ring; and the inner ring having a plurality of ring slits, at least one of the ring slits positioned between two adjacent bands of the bands, and a longitudinal dimension of each of the ring slits in a generally radial direction with respect to the cup receiving opening.

2. The cup carrier of claim 1 wherein the ring slits are positioned near an outer perimeter of the inner ring.

3. The cup carrier of claim 1 wherein the ring slits are positioned at an approximate midpoint between two adjacent bands of the bands.

4. The cup carrier of claim 1 wherein the handle has a central grasping slit.

* * * * *